US010309733B2

(12) United States Patent
Kim et al.

(10) Patent No.: US 10,309,733 B2
(45) Date of Patent: Jun. 4, 2019

(54) APPARATUS AND METHOD FOR INCREASING BOILING HEAT TRANSFER THEREIN

(71) Applicant: PURDUE RESEARCH FOUNDATION, West Lafayette, IN (US)

(72) Inventors: Tae Young Kim, Lafayette, IN (US); Suresh V. Garimella, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 754 days.

(21) Appl. No.: 14/383,346

(22) PCT Filed: May 24, 2013

(86) PCT No.: PCT/US2013/042713
§ 371 (c)(1),
(2) Date: Sep. 5, 2014

(87) PCT Pub. No.: WO2013/177547
PCT Pub. Date: Nov. 28, 2013

(65) Prior Publication Data

US 2015/0068712 A1 Mar. 12, 2015

Related U.S. Application Data

(60) Provisional application No. 61/651,057, filed on May 24, 2012, provisional application No. 61/787,132, filed on Mar. 15, 2013.

(51) Int. Cl.
*F28F 13/18* (2006.01)

(52) U.S. Cl.
CPC ..... *F28F 13/187* (2013.01)

(58) Field of Classification Search
CPC ..... F28F 13/187; H05K 7/208; H01L 23/427; F28D 17/005
(Continued)

(56) References Cited

U.S. PATENT DOCUMENTS 4,291,758 A * 9/1981 Fujii ..... F28F 13/187 165/133
4,730,665 A * 3/1988 Cutchaw ..... H01L 23/433 165/185
(Continued)

FOREIGN PATENT DOCUMENTS

JP 04371800 A * 12/1992 ..... F28F 13/187
SE 200301262 A * 12/2004

OTHER PUBLICATIONS

International Search Report for PCT/US13/042713 dated Sep. 5, 2013.

*Primary Examiner* — Tho V Duong
(74) *Attorney, Agent, or Firm* — Hartman Global IP Law; Gary M. Hartman; Domenica N. S. Hartman

(57) ABSTRACT

An apparatus and a method of enhancing boiling heat transfer therein capable of increasing both the critical heat flux and nucleate boiling heat transfer of a working fluid. The method includes placing free particles on a surface so as to define narrow corner gaps and cavities at interfaces between the particles and the surface and heating the surface while the surface is contacted by the working fluid to bring the working fluid to a boil, with the result that bubble nucleation is facilitated and nucleate boiling heat transfer from the surface is increased.

24 Claims, 8 Drawing Sheets

(58) Field of Classification Search
USPC ..... 165/133, 104.21
See application file for complete search history.

(56) References Cited

U.S. PATENT DOCUMENTS

| | | | | | |
|---|---|---|---|---|---|
| 4,884,169 | A * | 11/1989 | Cutchaw | H01L 23/427 | 165/104.33 |
| 5,814,392 | A * | 9/1998 | You | B05D 5/02 | 427/386 |
| 6,119,770 | A * | 9/2000 | Jaber | F28F 1/26 | 165/133 |
| 7,353,860 | B2 * | 4/2008 | Erturk | F28D 15/043 | 165/104.19 |
| 7,749,962 | B2 * | 7/2010 | Wieder | A61K 31/203 | 424/130.1 |
| 2007/0102070 | A1 | 5/2007 | Tuma et al. | | |
| 2007/0202321 | A1 | 8/2007 | You | | |
| 2009/0226701 | A1 | 9/2009 | Carbone | | |
| 2011/0023726 | A1 | 2/2011 | Nesbitt | | |
| 2012/0279068 | A1 * | 11/2012 | Mahefkey | F28D 15/046 | 29/890.032 |

* cited by examiner

APPARATUS AND METHOD FOR INCREASING BOILING HEAT TRANSFER THEREIN

CROSS REFERENCE TO RELATED APPLICATIONS

This application claims priority to International Patent Application No. PCT/US13/42713, filed May 24, 2013, which claims the benefit of U.S. provisional patent application Ser. Nos. 61/651,057, filed May 24, 2012, and 61/787,132, filed Mar. 15, 2013, The contents of these prior patent applications are incorporated herein by reference.

BACKGROUND OF THE INVENTION

The present invention generally relates to increased boiling heat transfer. More particularly, this invention relates to a free-particle technique wherein free particles are located on a superheated surface submerged in a liquid during boiling in order to increase boiling heat transfer.

The heat dissipation efficiency of phase-change processes for cooling high-performance microprocessors and thermal management of industrial engines, reactors, and plants, has motivated development of numerous techniques for pool boiling heat transfer enhancement. As the performance and density of modern electronics and electromechanical systems rapidly increase and phase-change cooling becomes more prevalent, concepts for facilitating bubble nucleation at reduced superheat temperatures and intensifying the nucleate boiling process have been suggested for heat transfer enhancement. Boiling heat transfer enhancement techniques usually fall into three categories: integral surface roughness, surface coatings, and attached nucleation promoters. The typical enhancement mechanisms of surface treatment techniques for boiling heat transfer enhancement provide preferential nucleation sites on the heated surface or alter the physical properties of the working fluid.

There is long-standing acknowledgment that surface roughening provides improvement in boiling heat transfer. However, reliance on this enhancement has been considered commercially intractable due to aging effects and difficulty in achieving repeatable/predictable performance. Alternatively, since the contact angle of a liquid on a heated surface affects bubble nucleation, researchers have investigated nonwetting surface coatings, such as paraffin and Teflon. Since nonwetting coatings are able to provide nucleation sites at a lower surface superheat compared to wetting surfaces, nucleate boiling heat transfer can be improved at relatively lower heat fluxes. However, large contact angles limit nucleation site density and vapor blanketing of the surface occurs at a lower superheat. Nonwetting layers formed of low thermal conductivity materials also undesirably increase the surface thermal resistance. Patterning surfaces with alternating wetting and nonwetting areas to bypass this tradeoff inherent to homogeneous non-wetting coatings have also been proposed and investigated.

Significant enhancements of pool boiling have been realized by various types of attached promoters, such as porous particle layers, wire meshes, and pin-fin structures. These promoters are usually thermally conductive and directly attached to the superheated surface, for example, through sintering. Compared to smooth surfaces, changes in local surface topography due to the presence of the attached promoters facilitates bubble nucleation at lower wall superheats, and results in more effective heat transfer from the surface to the working fluid. In order to increase both the nucleate boiling heat transfer coefficient and critical heat flux (CHF), the microscale structures in these studies were also designed to reduce liquid-vapor counterflow resistance, that is, the flow resistance to vapor escaping from a surface and to liquid returning to the gaps and cavities where it was vaporized. Despite nucleate boiling heat transfer improvements, the cumbersome processes required for fabrication and attachment of these microstructures to a surface is often considered a drawback. Therefore, simpler methods have been proposed for spraying/painting a mixture of metal particles, binder, and carrier on a target surface to form particle porous layers attached to the surface. However, deterioration of boiling heat transfer has been reported as a result of an increase in thermal resistance between the heated surface, particles, and working fluid due to the use of binders that exhibit relatively low thermal conductivity.

An additional enhancement technique not described above involves the use of fluid additives. In particular, use of nanoscale particles as additives in nanofluids for boiling heat transfer enhancement has been studied, but the effects on boiling heat transfer have been subject to dispute. A range of observations, such as mild improvement, mild deterioration, and negligible impact on boiling heat transfer, have been reported for nanofluids. One commonality is improvement in CHF reported by several studies on nanofluids, such as S. M. You, J. H. Kim, K. H. Kim, *Effect of nanoparticles on critical heat flux of water in pool boiling heat transfer*, Applied Physics Letters 83 (16) (2003) 3374-3376, and S. J. Kim, I. C. Bang, J. Buongiorno, L. W. Hu, *Surface wettability change during pool boiling of nanofluids and its effect on critical heat flux*, International Journal of Heat and Mass Transfer 50 (2007) 4105-4116, whose results are primarily attributed to deposition of thin particle layers on a heated surface during nucleate boiling process. The deposited particle layers increase wettability of the surface and decrease the contact angle between the surface and the working fluid, thus resulting in CHF enhancement.

In view of the above, there is an ongoing desire for improved boiling heat transfer methods that are capable of increasing the nucleate boiling heat transfer coefficient and CHF of a working fluid.

BRIEF DESCRIPTION OF THE INVENTION

The present invention provides an apparatus and a method of enhancing boiling heat transfer therein capable of increasing both the CHF and nucleate boiling heat transfer of a working fluid by locating free particles on a superheated surface submerged in the working fluid during boiling in order to enhance boiling heat transfer.

According to a first aspect of the invention, a method of increasing boiling heat transfer from a surface includes placing free particles on the surface so as to define narrow corner gaps and cavities at interfaces between the particles and the surface and heating the surface while the surface is contacted by a working fluid to bring the working fluid to a boil, with the result that bubble nucleation is facilitated and nucleate boiling heat transfer from the surface is increased.

According to a second aspect of the invention, an apparatus includes a heated surface, a working liquid in contact with the surface, and free particles submerged in the working fluid and located on the surface so as to define narrow corner gaps and cavities at interfaces between the particles and the surface. The working fluid is boiling as a result of heat transfer from the heated surface to the working fluid.

Bubble nucleation and an increase in nucleate boiling heat transfer from the surface are facilitated by the narrow corner gaps and cavities.

A technical effect of the invention is the ability to improve boiling heat transfer in a working fluid. In particular, it is believed that, by placing free particles on a superheated surface, both the CHF and nucleate boiling heat transfer of the working fluid will be improved.

Other aspects and advantages of this invention will be better appreciated from the following detailed description.

DETAILED DESCRIPTION OF THE INVENTION

Figure 1:
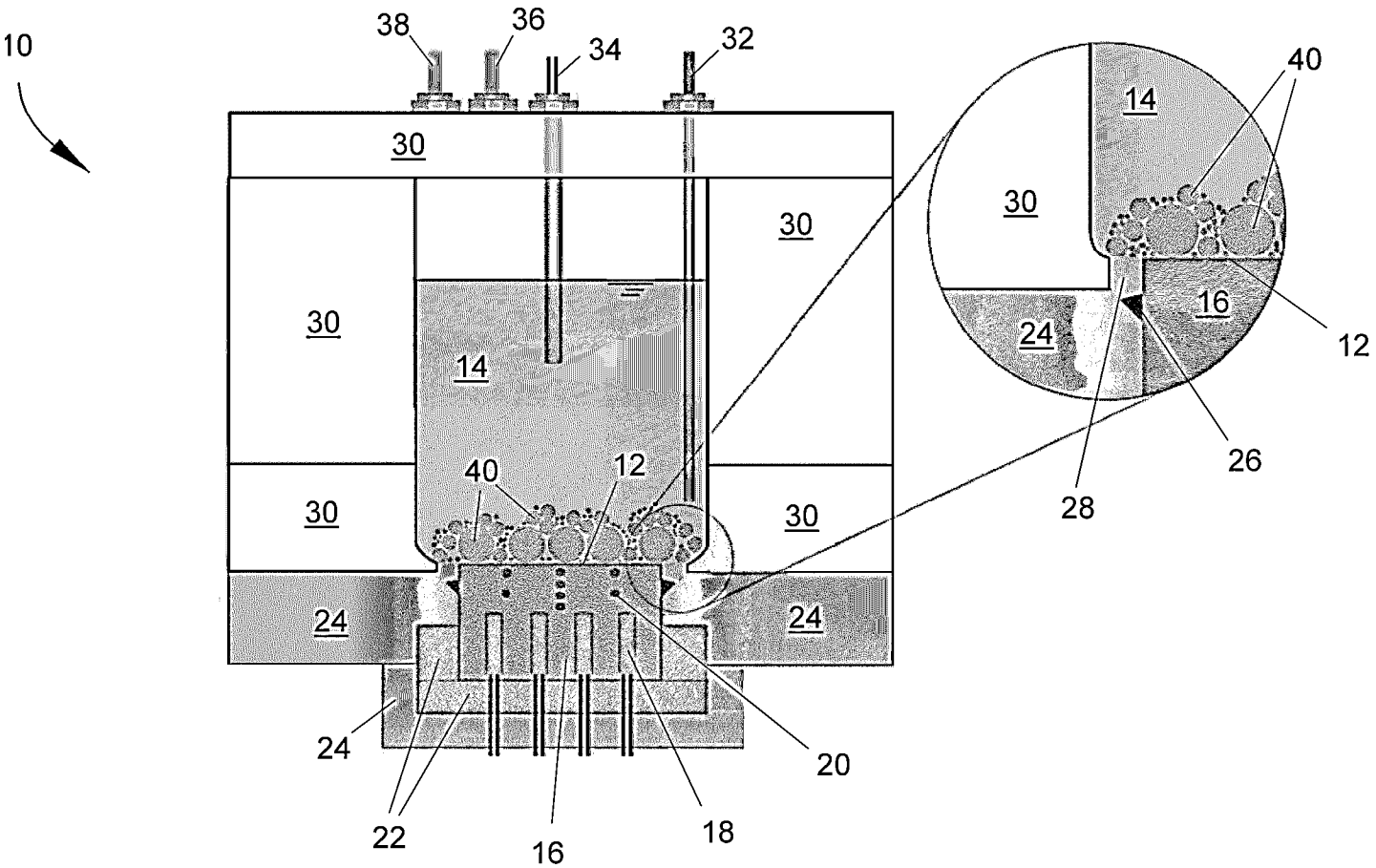
FIG. 1 is a schematic diagram representing a pool boiling facility used during experiments leading to aspects of the present invention.

The present invention provides free-particle techniques for immersion boiling heat transfer enhancement. These methods may be utilized in various working fluids to facilitate bubble nucleation at reduced superheat temperatures and to intensify the nucleate boiling process for heat transfer enhancement. The invention is generally applicable to improving heat dissipation efficiency in liquids and is specifically applicable to phase-change processes for cooling high-performance microprocessors, thermal management of industrial engines, reactors, and plants, and potentially various other applications.

Mathematical equations contained hereinafter include the following nomenclature: A for vapor bubble area, F for force, h for Planck's constant, height, or heat transfer coefficient, J for bubble nucleation density, k for Boltzmann constant, $N_0$ for number of molecules per unit volume, P for pressure, q for heat flux, r for radius, R for particle radius in y-coordinate direction, $R_{RMS}$ for root mean squared surface roughness, T for temperature, x for x-coordinate direction, y for y-coordinate direction, s for thermocouple rake spacing, β for half-angle of the corner of a microchannel or cavity, ρ for density, σ for surface tension, θ for solid-liquid-vapor contact angle, ω for geometric correction factor, and ψ for surface available for heterogeneous nucleation per unit bulk volume of liquid phase. Subscripts of the above nomenclature comprise b for bubble, buoyancy force, or liquid-vapor-particle contact point, c for liquid-vapor-particle contact point or capillary force, cb for capillary force at liquid-vapor-surface contact point, ct for capillary force at liquid-vapor-particle contact point, dep for departure, e for effective force, f for point of force, l for liquid, p for particle, w for wall or water, and j for thermocouple junction.

Generally, immersion boiling enhancement techniques described herein entail placing free (non-fixed, unattached) particles, which may be orders of magnitude larger than nanoparticles, on a surface, and then heating the surface while the surface is contacted by a working fluid to bring the fluid to a boil, with the result that bubble nucleation is facilitated and nucleate boiling heat transfer from the surface is enhanced. Preferably, the particles are formed of a conducting material and are chemically stable in the fluid. The primary function of the particles is to change the local topography of the surface by defining narrow corner gaps and cavities at the interfaces between the particles and surface. According to a particular aspect of the invention, these gaps and cavities are capable of promoting bubble nucleation, and consequently enhance nucleate boiling at low heat fluxes. This nucleation enhancement mechanism differs from the use of porous promoters attached to heated surfaces, in that the particles are not affixed to the heated surface, but instead are free to move on and relative to the surface.

Heterogeneous bubble nucleation density ($J_{het}$) may be described using classical kinetics of nucleation, which is given as $$J_{het} = N_0^{2/3}\psi\left(\frac{kT_{nl}}{h}\right)\exp\left\{-\frac{16\pi\sigma^3\omega}{3kT_{nl}(P_b - P_1)^2}\right\} \quad (1)$$

where ω is the geometric correction factor for the minimum work required to form a critical nucleus. This factor depends on the contact angle for the solid-liquid interface, θ, and the local geometry of the surface, β, which can be expressed as $$\omega = \frac{\beta}{2\pi}(1+\cos\theta)^2(2-\cos\theta) \quad (2)$$

Due the presence of the corner geometry, the incipient superheat is decreased compared to a flat surface. It is believed that a decrease in the incipient wall superheat for surfaces with attached (sintered) particle layers is attributable to corner cavities defined where the particles attach to the heated surface. In free-particle techniques of the present invention, narrow corner gaps and cavities present between the particles and the heated surface preferentially serve as active nucleation sites by decreasing the geometric correction factor in Eq. 1, and as a result, the wall superheat needed for boiling incipience decreases.

Comprehensive experimental studies were performed that evidenced an enhancement potential when using water and a dielectric fluid, FC-72 ($C_6F_{14}$) commercially available from the 3M Company, as the working fluid, and to identify optimum particle sizes for the tested conditions. As known in the art, FC-72 is a fluorocarbon, specifically perfluorohexane (or tetradecafluorohexane), and has found use in low temperature applications, for example, as an electronic cooling liquid/insulator, due to a low boiling point. Extensive series of experiments were conducted to investigate the effect of various sizes and numbers of free (non-fixed, unattached) copper particles on boiling heat transfer. Experimental results showed that free micro scale-size (that is, in the range of 1 to 999 micrometers) particles placed onto a superheated surface were capable of effectively facilitating bubble nucleation and thus enhance nucleate boiling heat transfer. However, depending on the working fluid, the placement of excess quantities of free particles on a heated surface may significantly deteriorate the critical heat flux by increasing the liquid-vapor counterflow resistance, that is, an increase in the flow resistance to vapor escaping from a surface and to liquid returning to the gaps and cavities where it was vaporized, under vigorous boiling conditions. Due to differences in working fluid properties, millimeter-size (that is, equal to or greater than one millimeter, particularly about 3 to 6 mm over a heat flux of 20 to 100 kW/m$^2$) particles identified as optimum particle sizes for boiling of water appeared to achieve little improvement of nucleate boiling heat transfer in FC-72, and significantly reduced critical heat flux. Instead, an optimum particle size for improving nucleate boiling and increasing the critical heat flux for FC-72 was identified to be micron-sized (particularly about 10 microns) particles.

The series of experiments evidenced that optimal performance of the free particle technique was directly correlated with the incipience wall superheat. The required boiling incipience superheat depended on the size of the free particles, which influenced the surrounding liquid temperature profile and the vapor bubble growth, resulting in an optimum. In order to validate this hypothesis, numerical simulations and an analytical force balance were carried out to predict the surrounding liquid temperature for a superheated wall and predict vapor bubble growth and departure. The model was shown to corroborate the experimental observations.

Development of a model that can predict the optimal particle size for the free-particle technique was concluded to significantly extend the potential scope of applications for the free particle technique. The model allowed for variation of particle size and working fluid/solid thermophysical properties. Therefore, while testing was only performed at atmospheric pressure, the technique can be utilized for variable operating pressure and high-pressure applications, and optimized by tuning the model input properties as appropriate. The fundamental boiling incipience enhancement mechanism by the free particles is independent of the fluid saturation pressure and temperature.

FIG. 1 is a schematic diagram of a pool boiling facility 10 used in the aforementioned experimental studies. A surface 12 of a copper heat block 16 (2.54 mm×2.54 mm for water; 25.4 mm×25.4 mm for FC-72) is represented as being in contact with a liquid bath 14 consisting of a working fluid. The surface 12 was polished to a mirror-finish to have a surface roughness, $R_{RMS}$, of 25 nm as measured by a non-contact, 3D, scanning white light interferometer (NewView 6200, Zygo Corp.). A uniform heat flux was supplied to the surface 12 through twelve cartridge heaters 18 embedded in the heat block 16. The block temperature was monitored by a rake of embedded T-type thermocouples 20. The side and bottom surface of the heat block 16 were shrouded by ceramic insulation 22 and installed in a housing 24 formed of PEEK (polyether ether ketone). To seal the surface 12 to the housing 24, sealant and epoxy layers 26 and 28, respectively, were applied around the edge of the surface 12 of the heat block 16, as represented in FIG. 1. This assembly was attached to the bottom of a square polycarbonate liquid tank 30. A stainless steel condenser coil 36 with a circulating 50-50 water-glycol mixture at about 44° C. served to condense vaporized working fluid from the liquid bath 14. The tank 30 was connected to an ice bath vapor trap 38 open to the ambient environment, hence all tests were performed at atmospheric pressure. The temperature of the liquid bath 14 was monitored with a thermocouple 32.

The facility 10 was initially filled with about 45 ml of the working fluid, which was either water or FC-72 during the investigations. A degassing process was performed on the working fluid by boiling the fluid using a cartridge heater 34 for at least two hours prior to every experiment. To reduce the liquid level beneath the condenser coil 36 following degassing, the liquid bath 14 was drained using a syringe until about 25 ml of the fluid remained in the facility 10. Copper particles 40 of a desired quantity and size were gently placed on the heated surface 12 to avoid scratching the surface 12. After degassing, the heat flux supplied by the cartridge heaters 18 was incrementally increased to obtain boiling curves. Thermocouple temperature data were collected when steady-state conditions were satisfied at each discrete heat flux increment. Steady-state operation was assumed to occur when the time-averaged variation of the wall superheat temperature, acquired every three seconds, was less than 0.0003° C./s for 150 seconds. Once steady-state conditions were satisfied, time-averaged temperature data were obtained from thirty measurements collected over ninety seconds, and was used to calculate the actual surface heat flux and the corresponding wall superheat as described above. When using water as the working fluid, the maximum heat flux was limited to about 100 kW/cm$^2$ because vigorous boiling at this heat flux caused the liquid bath 14 to directly contact with the condenser coil 36. Therefore, CHF measurements were not acquired in these test cases.

Figure 2:
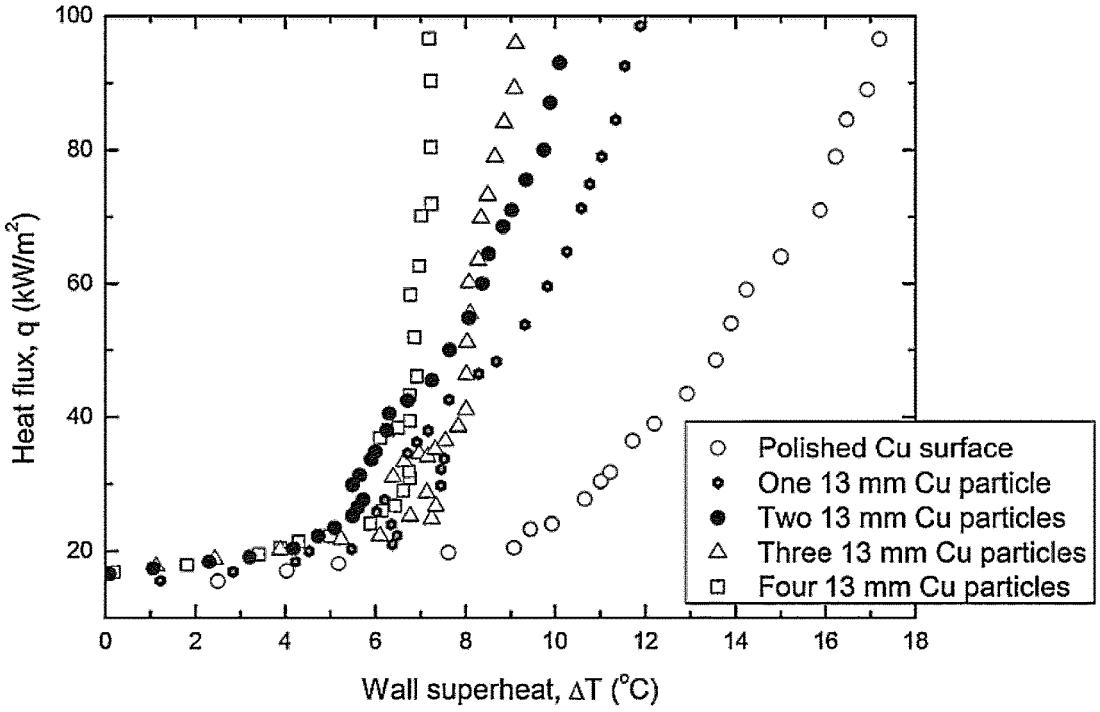
FIG. 2 is a chart representing boiling curves for variable quantities of non-spherical 13 mm diameter free particles on boiling heat transfer from a first series of experiments using water as a working fluid.

A first series of experiments was conducted using water as the working fluid. In order to investigate the effect of the number of free particles on boiling heat transfer of water, an increasing number of 13 mm diameter particles 40 were placed on the surface 12 (2.54×2.54 mm). A total of one to four particles 40 were able to fit on the surface 12 in a single layer. For this series of experiments, the 13 mm particles 40 used were not perfectly spherical. FIG. 2 shows the boiling curves for each test case. Based on the wall superheat as a function of heat flux shown, the performance monotonically increased with the number of particles 40 used. The surface 12 without particles 40 had the worst thermal performance, and four 13 mm particles 40 provided the largest improvement in boiling heat transfer. This effect was most pronounced at high heat fluxes. The trends in the individual boiling curves, with respect to varying number of particles 40, are discussed in detail below.

For any number of 13 mm particles 40, heat transfer to the fluid first occurred by natural convection, and was followed by a surface temperature overshoot at the onset of nucleate boiling (ONB), as shown in FIG. 2. The overshoot was more noticeable in the transient temperature data than revealed by the steady state points on the boiling curve. This immediate reduction in the wall superheat indicates a significant enhancement in the heat transfer coefficient, which was attributed to transition from natural convection to boiling. Since activation occurred at a different heat fluxes, the temperature overshoot was relatively scattered for the surface 12 with the particles 40, and occurred at multiple heat fluxes, compared to the surface 12 without particles 40, for which bubble nucleation incipience was a single event at a heat flux of about 40 kW/m$^2$.

In the case of a single 13 mm particle 40, vapor bubbles large enough to surround the entire millimeter-sized particle were generated. The particle 40 oscillated on the surface 12 during boiling due the vapor bubble buoyant forces, but remained in contact with the surface 12 and continued to provide nucleation sites. Intense nucleate boiling was observed throughout the entire heat flux range for millimeter-sized free particles 40, but was not observed for the surface 12 without particles 40. Vapor bubble generation caused by the millimeter-sized the particles 40 in water was the primary mechanism by which the heat transfer coefficient was enhanced compared to the surface 12 absent particles 40. Unlike tests performed with two or more particles 40, for which the position of particles 40 was confined by the side walls and other particles 40, the particle motion was relatively unrestricted for the case of one 13 mm particle 40. Thus, when boiling began, the single particle 40 was pushed by vapor release from the narrow corner cavity and moved on the surface 12 through a translational or rolling motion. If a cavity geometry formed between the particle 40 and the surface 12 was not proper for bubble nucleation, boiling was suppressed, which yielded a sharp increase in the wall superheat until the heat flux was increased and the particle 40 again became active for nucleate boiling. This caused multiple incipience overshoot events even for a single particle 40, which can be observed in FIG. 2. At higher heat fluxes, the particle 40 continually provided active nucleation sites regardless of the contact due to the large surface superheat.

Table 1 summarizes the boiling heat transfer characteristics as a function of the number of particles 40 on the surface 12. Onset of nucleate boiling occurred at a wall superheat of approximately 6° C. (FIG. 2) independent of the number of particles 40, but the heat flux required for ONB decreased for an increasing number of particles 40. This was attributed to an increased natural convection heat transfer area. The thermally conductive particles 40 acted as extended surfaces. Thus, for a greater number of particles 40, a higher base heat flux was achieved in the natural convection regime for a constant wall superheat. For this reason, the particles 40 are preferably formed of a material that is more conductive than the working fluid.

TABLE 1

Boiling heat transfer characteristics as a function of the number of free particles.

| Number of Particles | q at ONB (kW/m$^2$) | ΔT at 100 kW/m$^2$ (° C.) |
|---|---|---|
| 1 | 25.7 | 13.2 |
| 2 | 29.6 | 11.9 |
| 3 | 31.3 | 10.4 |
| 4 | 36.6 | 7.3 |

Figure 3:
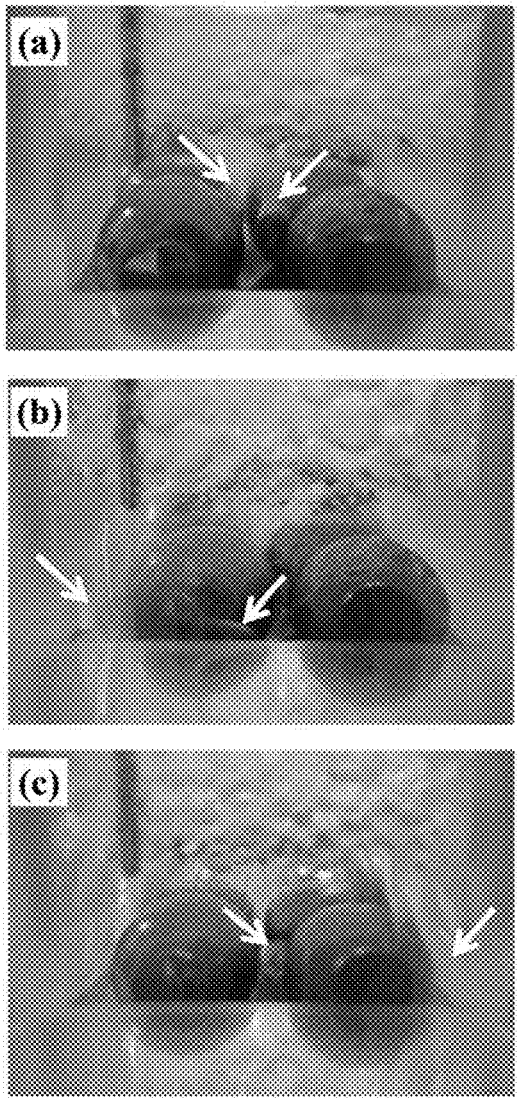
FIG. 3 is a set of scanned images representing macroscopic visualization of nucleate boiling from four 13 mm free particles at heat fluxes of (a) 37 $kW/m^2$, (b) 45 $kW/m^2$, and (c) 72 $kW/m^2$. Arrows in each image indicate the vapor bubbles generated by newly activated free particles at the corresponding heat flux.

The case with four 13 mm particles 40 was used to describe the boiling curve trends following initial incipience when multiple particles 40 were placed on the surface 12. In the low heat flux range, below 37 kW/m$^2$, heat transfer occurred by natural convection. When the heat flux reached 37 kW/m$^2$, nucleate boiling was initiated and vapor bubbles departed from the narrow corner gaps and cavities. In this case, incipience occurred simultaneously at the two rear particles 40 in the image in FIG. 3(*a*). Due to the efficient thermal energy transfer from the heated surface by means of the large vapor bubbles generated, the wall superheat immediately decreased by approximately 1° C. at incipience. At a heat flux of about 45 kW/m$^2$, a nucleation site activated at the base of the particle 40 placed at the left front corner in the image in FIG. 3(*b*). As the heat fluxes further increased and reached 72 kW/m$^2$, boiling activated the last particle 40, as represented in FIG. 3(*c*). Each time an individual particle 40 provided a new nucleation site, a small decrease in the wall superheat was observed.

This succession of incipience events, and associated reduction in wall superheat, was concluded to explain the trend in wall superheat at 100 kW/m$^2$ for an increasing number of particles 40. At this heat flux, all individual particles 40 for each test case had transitioned into the boiling regime. As shown in Table 1, the boiling regime wall superheat decreased with an increasing number of the particles 40. The surface 12 with four 13 mm particles 40 maintained comparatively low wall superheats due to consecutive activation of particles 40 along the boiling curve, whereas the other cases were deficient in nucleation sites at high heat fluxes. For the surfaces with fewer particles 40, much of the surface 12 remained in the convection heat transfer regime even at 100 kW/m$^2$, and was reason for the lower overall surface heat transfer coefficient. Preferably, the particles 40 are of a sufficient quantity so as to promote boiling over the entirety of the surface 12.

To identify the optimum free particle size for maximizing the boiling heat transfer performance, the particles 40 with sizes ranging from 20 nm to 13 mm were studied. The number of spherical millimeter-sized particles 40 was chosen such that a single layer of particles 40 covered the entire test surface (100, 25, 9, and 4 particles 40 for 3, 6, 9, and 13 mm particle diameter, respectively). A monolayer could not be ensured by counting the number of sub-millimeter particles 40. The mass of sub-millimeter particles 40 placed on the surface 12 was chosen to provide the same projected surface coverage area assuming spherical particles 40 and a tight packing density.

Figure 4:
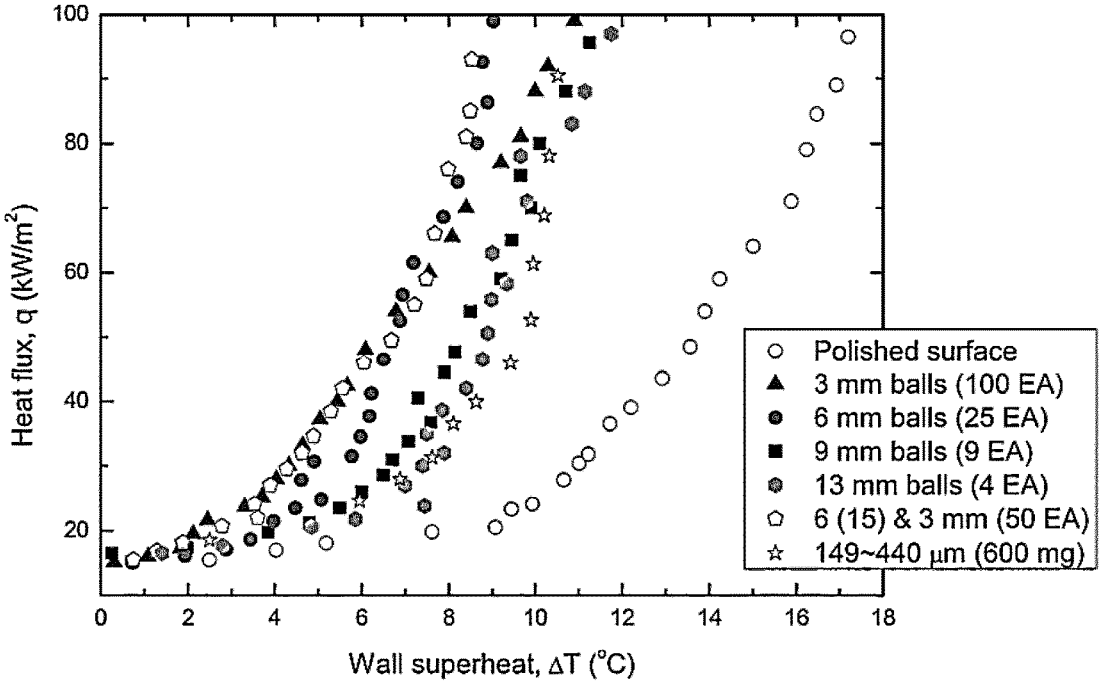
FIG. 4 is a chart representing boiling curves for a range of spherical free particles from the second series of experiments using water as a working fluid.

The experimental results for varying the particle size are shown in the boiling curve in FIG. 4. Generally, as the size of particle 40 decreased from 13 mm to about 3-6 mm, the overall boiling heat transfer performance increased (lowest average surface superheats over different heat flux ranges). However, as the particle size further decreased to 140-440 μm particles 40, the heat transfer performance decreased. Experimental cases using 10 μm and 20-40 nm particles 40, whose results are not shown in FIG. 4, had little effect on the heat transfer performance compared to the surface 12 without the particles 40. For the free-particle technique, it was concluded that 3 mm to 6 mm particles 40 were optimum when water was used as the working fluid. This suggests a different primary enhancement mechanism from previous studies in the literature which considered nanofluids or fixed structures with sub-millimeter feature sizes for pool boiling enhancement. The detailed trends in the boiling curves are discussed for varying particle size below, followed by a model-based validation of the postulated enhancement mechanism.

At low heat fluxes, below 50 kW/m$^2$, the relative performance of varying size particles 40 was dependent on boiling incipience and the number of activate nucleation sites. As the particle size decreased from 13 mm to 3 mm, the wall superheat at incipience decreased monotonically from 7.5° C. to 2.5° C. The 3 mm particles 40 had the best average corresponding heat transfer performance up to 50 kW/m$^2$. When the particle size was further reduced to 149-400 μm, the incipience superheat increases, and boiling performance was reduced. Based on the direct relationship observed between the low heat flux thermal performance and a reduced incipient wall superheat, vapor bubble nucleation theory can be used to explain the optimum. For the same cavity shape and constant fluid properties, a larger cavity size (i.e., particle diameter) required less superheat for bubble growth and detachment when only considering the force required to overcome surface tension. However, the vapor embryo must also stay enveloped in superheated liquid layer. When considering the temperature gradient in the liquid near the wall, too large of a vapor embryo (or associated cavity size) will fail this superheating requirement. This tradeoff leads to an optimum particle size for minimum surface superheat at incipience.

At higher heat fluxes, the optimum particle size shifted. The slope of the boiling curve was sharper for 6, 9, and 13 mm particles 40 than the 3 mm particles 40, resulting in a performance cross over point at 50 kW/m$^2$, above which 6 mm particles 40 provide the best performance. At high heat fluxes, for the smaller particle sizes, it was observed that bubbles generated at individual cavities coalesced as they rose through the particle layer. The elongated solid-liquid-vapor contact line formed by these coalesced bubbles likely increased the capillary force which resists departure, and therefore increased the necessary surface superheat for bubble departure at the same frequency. It was observed that the size of vapor bubbles generated by the particles 40 increased with increasing particle size at similar heat fluxes, but the nucleation site density decreased. While the combination of mechanisms resulting in an optimum free particle size during vigorous boiling at high fluxes was less clear than at incipience, the first series of experiments indicated that this trade off exists. Under the conditions of the experiment, 6 mm particles 40 provided the best thermal performance in terms of the total volume of vapor released from the surface 12 at high heat fluxes, which was determined by a combination of the number of nucleation sites, bubble departure frequency, and the size of each vapor bubble.

A brief discussion of the effective of particle shape on boiling performance was warranted based on the differing results between non-spherical (FIG. 2) and spherical (FIG. 4) 13 mm particles 40. The four non-spherical particles 40, as illustrated in FIG. 2, maintain the wall superheat at around 7° C. for the highest heat flux investigated, whereas the four 13 mm spherical particles 40 presented in FIG. 4 reach a maximum surface superheat over 10° C. Therefore, the shape of the particles 40 clearly had a significant influence on boiling heat transfer. The shape of the particles 40 placed on the surface 12 would affect various boiling parameters such as the contact area between the particles 40 and the surface 12, the shape and the angle of narrow corner gaps and cavities, and mixing of the fluid trapped in the gaps and cavities. Further study on the effect of the particle shape was required to fully understand these trends.

These experiments suggested that thermal performance and optimum particle size correlate with a reduced wall superheat at incipience. The required boiling incipience superheat depends on the size of the particles 40, which influenced the surrounding liquid temperature profile and the vapor bubble growth, and results in an optimum. In order to validate this hypothesis, numerical simulations and an analytical force balance were carried out to predict the surrounding liquid temperature for a superheated wall and predict vapor bubble growth and departure.

Figure 6:
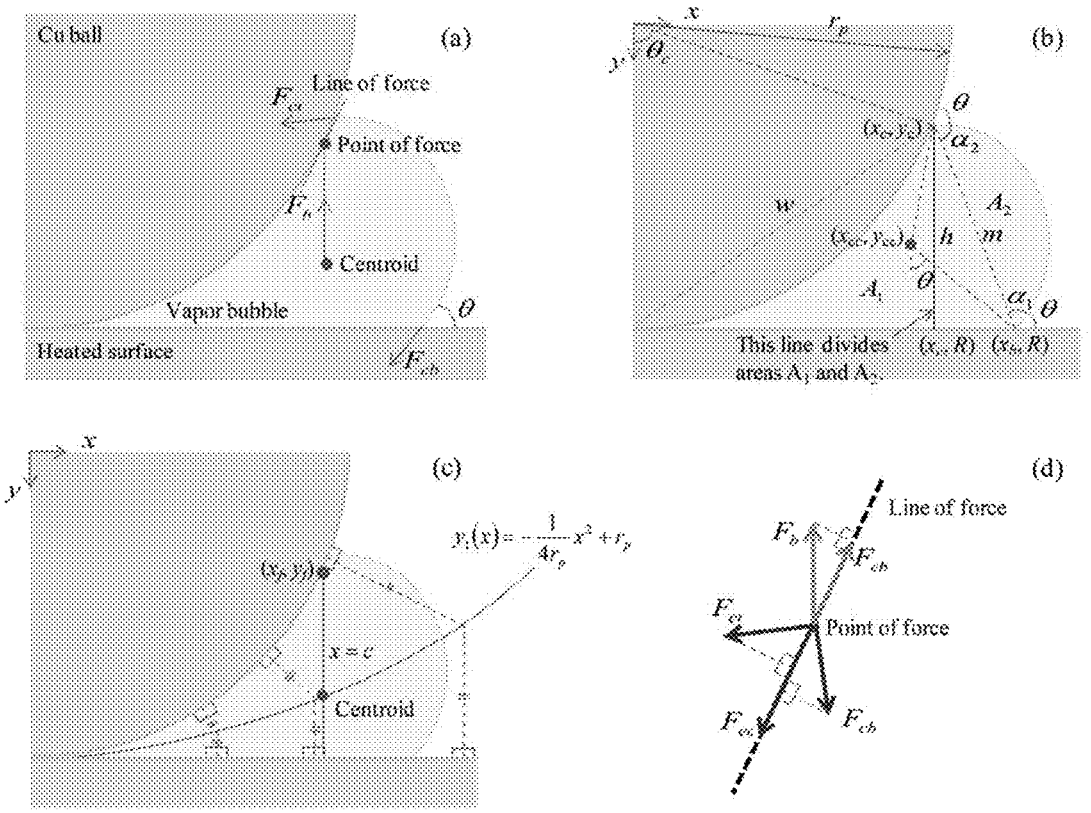
FIG. 6 is a set of schematic diagrams representing a vapor embryo force balance model for a spherical particle on a heated surface. The diagrams represent the (a) force balance diagram, (b) decomposed bubble geometry, (c) equation for centroid of the bubble, and (d) the effective buoyant force and capillary forces.

An analytical model was developed to predict the vapor bubble size required for departure from the surface 12. In the model, a vapor bubble embryo was assumed to originate from a narrow corner cavity between the surface 12 and spherical particle 40. Since vapor bubbles were generated around the circumference of the particle base, a two-dimensional axisymmetric representation of the particle, vapor, and liquid domains was used. This geometry is depicted in FIG. 6(*a*). The buoyant force, $F_b$, of a vapor bubble generated at a narrow corner cavity was calculated by estimating the shape and the size of the vapor bubble during growth. The resulting buoyant force was then compared to the capillary force, $F_c$, (caused by surface tension of the working fluid) in order to predict the required size of the bubble necessary to be released from the cavity. The procedure to find the size of a bubble at detachment was as follows:

1. Assume an initial small value of $x_c$, the x-location of the liquid-vapor-particle contact point.
2. For the given $x_c$, calculate the geometry and size of the vapor bubble.
3. Obtain the centroid of the vapor bubble.
4. Calculate the particle contact point of force and the directional line of force (surface tangent at the point of force).
5. Find the magnitude and direction of the buoyant force, $F_b$, and capillary forces, $F_{ct}$ and $F_{cb}$.
6. Project the buoyant and capillary forces onto the line of force and compare the effective buoyant force, $F_{eb}$, against the effective capillary force, $F_{ec}$.
7. Iterate steps 1 through 6 until the effective buoyant force equals the effective capillary force as $x_c$ is incrementally increased; this vapor bubble size was assumed to be the minimum required for departure.

The following discussion describes the calculation procedure for steps 2 through 6 in detail. The shape of the vapor bubble was defined by the equilibrium contact angle, θ, and was assumed to be 40 degrees C. The size of the bubble, $A_b$, was decomposed into two parts as shown in FIG. 6(*b*). Using the assumptions of $w=x_b$ and $\alpha=(\alpha_1+\alpha_2)/2$ to simplify the model, the decomposed areas can be calculated as $$A_1 = \frac{1}{2}(x_c h - R^2(\theta_c - \sin\theta_c)) \tag{3}$$

-continued $$A_2 = \int_{x_c}^{x_b}\left[\sqrt{r_b^2-(x-x_{cc})^2}+r_p-y_{cc}\right]dx + \int_{x_b}^{x_{cc}+r_b}\left[2\sqrt{r_b^2-(x-x_{cc})^2}\right]dx \;\; y_c>0 = \int_{x_c}^{y_p}\left[\sqrt{r_b^2-(x-x_{cc})^2}+r_p-y_{cc}-2\sqrt{r_p^2-x^2}\right]dx + \int_{r_p}^{x_b}\left[r_p-y_{cc}+\sqrt{r_b^2-(x-x_{cc})^2}\right]dx + \int_{x_p}^{x_{cc}+r_b}\left[2\sqrt{r_b^2-(x-x_{cc})^2}\right]dx \;\; y_c<0 \tag{4}$$

where $r_b$ and $(x_{cc}, y_{cc})$ are the radius and the coordinate of the center of the concave part of $A_2$, respectively, which are $$r_b = \frac{m}{2\cos(|\pi/2-\alpha|)} \tag{5}$$

$$x_{cc} = x_b - r_b\cdot\cos\left(a\tan\left(\frac{h}{x_b-x_{cb}}\right)+\alpha-\frac{\pi}{2}\right) \tag{6}$$

$$y_{cc} = R - r_b\cdot\sin\left(a\tan\left(\frac{h}{x_b-x_{cb}}\right)+\alpha-\frac{\pi}{2}\right) \tag{7}$$

The centroid of the bubble was obtained by finding the point of intersection point between two lines that divide the area of the bubble in half, which are $y_1(x)$ and the vertical line x=c as defined in FIG. 6(*c*). The vertical line x=c, in which c is a constant, was found by integrating the area of the bubble from $(0, r_p)$ along x-axis until the integrated area becomes half of the total bubble volume.

The point of force was the location where a vertical extension from the centroid meets the surface of the spherical particle. The line of force was the surface tangent at the point of force. The magnitudes of the buoyant force, which acts to pull the bubble from the cavity, and the capillary forces, which hold the bubble to the surface, can be expressed as $$F_b=\rho_w A_b(-g) \tag{8}$$

$$F_{ci}=F_{cb}=\sigma_w \tag{9}$$

assuming the water vapor density was negligible compared to the liquid density. The magnitudes of each force were projected on the line of force and converted into effective values as shown in FIG. 6(*d*). The two components of the capillary force that were projected onto the line of force sum as the total effective capillary force, $F_{ec}$. In order for the bubble to be released from the cavity, the effective buoyant force should be larger than the effective capillary force. If this criterion was not satisfied, the size of the bubble was iteratively increased by incrementally moving the contact point along the surface of the particle further from the base. The procedure was continued until the effective buoyant force just exceeds the effective capillary force, which was regarded as the minimum size of the bubble for detachment.

Through this procedure, the minimum departure size of the bubble generated at a narrow corner cavity was found. The size of the bubble required for detachment only depends on the diameter of the particle 40. The results from the model show that the minimum heights of the vapor bubble at departure, $h_{b,dep}$, were 3.4, 3.1, 2.9, and 3.4 mm for 3, 6, 9, and 13 mm diameter particles 40, respectively. The modeling results, which show the height for detachment in water to be on the order of 3 mm, compare reasonably against other studies in the literature. The current force balance model results were also in good agreement with the qualitative experimental observations in the above-described experiments.

While the previously described force balance model predicts the required bubble height at for departure, the temperature of the liquid that surrounds a bubble should be superheated to enable growth. Thus, in order for the vapor bubble to grow to the height for detachment, $h_{b,dep}$, the liquid in the entire region at this height should be superheated. Three-dimensional numerical simulations were performed to yield the liquid temperature profile as a function of the surface heat flux for the cases of a 3 mm and a 9 mm particle 40. The heat flux (and associated surface superheat) required to satisfy the superheated liquid region criterion was determined.

A one-quarter symmetric domain of a single particle 40, the surrounding liquid, and the adjacent surface 12 were modeled. The mesh for this domain was generated using computerized fluid dynamics software (GAMBIT and FLUENT) to solve the diffusion equation in the solid and liquid domain under the prescribed boundary conditions. Experimentally obtained heat fluxes were used as the surface boundary condition. A constant temperature boundary condition was applied at the top of the facility 10. This constant temperature boundary condition was iterated until the temperature at the location of the thermocouple 32 matched the experimental measurements. The resulting liquid temperature contours were used to determine if the liquid was superheated around the bubble size required for departure at the given heat flux.

Figure 7:
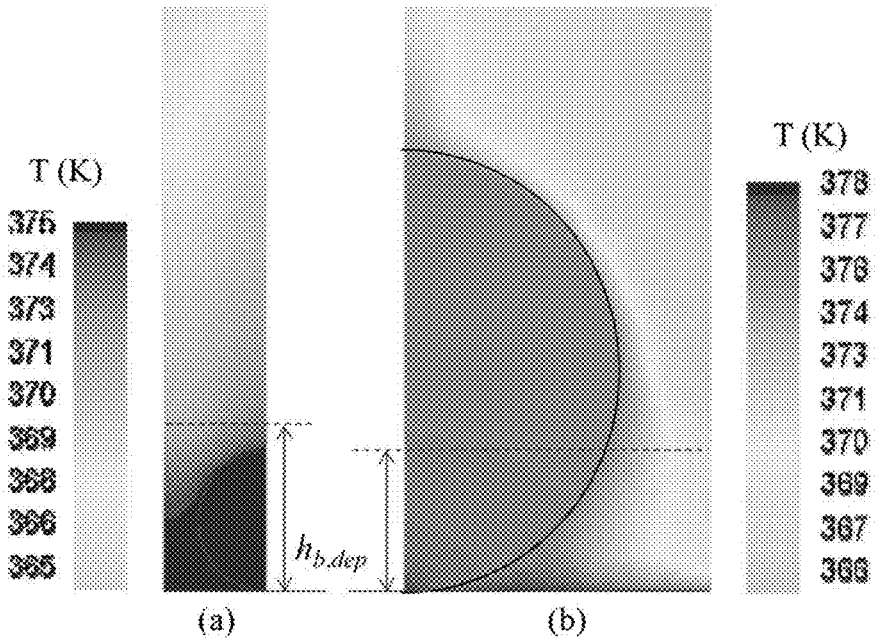
FIG. 7 is a set of schematic diagrams representing numerical simulation results that show the particle and liquid temperature profile for (a) a 3 mm diameter free particle at the heat flux of 19.5 $kW/m^2$ and for (b) a 9 mm diameter free particle at 23.5 $kW/m^2$. The heights of a vapor bubble required for departure, $h_{b,dep}$, from the heated surface obtained from the buoyant versus capillary force balance are indicated.

Results from numerical simulations presented in FIG. 7 show the liquid and solid temperatures in the solution domain for a 3 mm and a 9 mm particle 40. The height of the bubble at departure calculated from the force balance model is shown on top of these temperature contours. The 3 mm particle 40 increased the temperature of the working fluid in the region where liquid must be superheated for vapor bubble detachment at a heat flux 19.5 kW/m$^2$. Conversely, at a similar heat flux of 23.5 kW/m$^2$, the 9 mm particle 40 protruded further into the cooler liquid region, and conducts heat further away from the surface 12, rather than localizing heating to the liquid region critical for vapor bubble superheat and detachment. Therefore, for the case of 9 mm particle 40, a portion of the region where liquid should be superheated for bubble detachment was found to be below the saturation temperature at this heat flux. Therefore, even though the bubble departure height calculated by the force balance was smaller for the 9 mm particle 40, and should generate vapor more readily due to the sharper narrow corner cavity, boiling incipience will first occur for the 3 mm particle 40. This agrees with the experimental observations. It also explains the larger optimal particle size for water compared to FC-72. The lowered surface tension of FC-72 allows vapor departure at much smaller vapor bubble sizes, and the conductive particle 40 should be much smaller to effectively localize heating to the narrow corner cavity region.

From the vapor embryo force balance and thermal models, the advantage of larger particles 40 for reducing the required vapor bubble departure size, and smaller particles 40 for localized superheating of liquid near the surface 12, were identified. To capitalize on this tradeoff, mixtures of different sizes of particles 40 were tested. Of the different combinations of particles 40 tested, a mixture of fifty 3 mm particles 40 and fifteen 6 mm particles 40 provided the largest improvement to boiling heat transfer. The boiling curve for this case was included in FIG. 4. The boiling curve for the particle mixture provided the same optimum performance as one hundred 3 mm particles 40 at heat fluxes below 50 kW/m$^2$, and as twenty-five 6 mm particles 40 at heat fluxes above 50 kW/m$^2$. This was attributed to the interaction between different sizes of particles 40. The bubble departure size for the case of one hundred 3 mm particles 40 was on the order of 3 mm. However, for the case of the mixture of 3 and 6 mm particles 40, the sizes of vapor bubbles at ONB were approximately 6 mm. The proximity of smaller 3 mm particles 40, which effectively superheated the liquid for bubble growth, may increase the liquid temperature in the corner gaps and cavities of 6 mm particles 40 and help the larger particles 40 generate larger vapor bubbles. Thus, large vapor bubbles may be generated due to interaction between the 3 and 6 mm particles 40, improving boiling performance.

Figure 5:
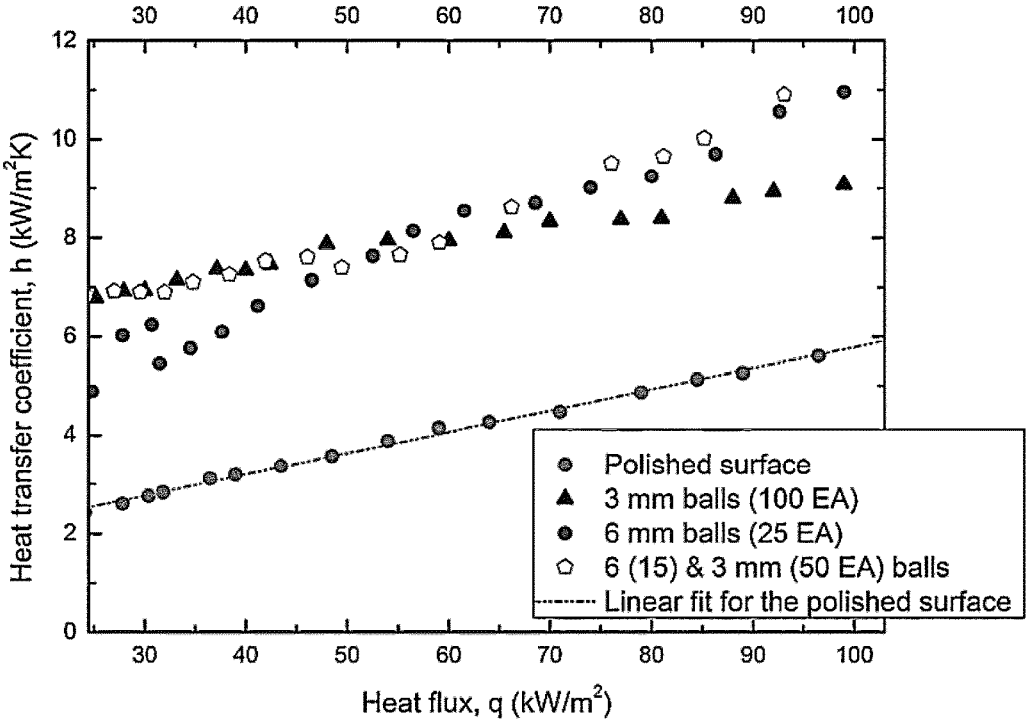
FIG. 5 is a chart representing boiling heat transfer coefficient versus heat flux curves for 3 mm and 6 mm free particles.

Boiling heat transfer enhancement was evaluated by comparing the heat transfer coefficients of an experimental case with the particles 40 to that of the surface 12 without the particles 40 at the same heat flux. FIG. 5 shows the heat transfer coefficients for several experimental cases as a function of the heat flux. A single boiling enhancement metric may be obtained by averaging the percentage improvement over the entire heat flux range for which all the experimental cases were in the nucleate boiling heat transfer regime (about 20-100 kW/cm$^2$ for 3 mm and 6 mm particles 40). The average percentage enhancement in nucleate boiling heat transfer coefficient for n data points in the heat flux range selected was quantified using the following equation $$\frac{\sum_{i=1}^{n} \frac{h_i - h_{p,i}}{h_{p,i}} \times 100}{n} \tag{10}$$

where h and $h_p$ are the heat transfer coefficients of the experimental case with the particles 40 and the surface 12 without the particles 40 at each heat flux. In order to compare over a continuous range of heat fluxes, $h_p$ was obtained from a polynomial fit to the heat transfer coefficient versus heat flux curve of the surface 12 without the particles 40, given as $$h_{p,i}=1.477+0.0043\times q_i \tag{11}$$

This evaluation indicated that the particles 40 may improve the boiling heat transfer by as much as 216%, using the optimum mixture of 3 mm and 6 mm particles 40 as compared to the case of the surface 12 without the particles 40.

A second series of experiments was conducted using FC-72 as the working fluid in the liquid bath 14. In order to determine the effect of the particle size on boiling of FC-72, experimental data for a range of sizes of the particles 40, from 20 nm to 3 mm, were obtained and are presented in boiling curves in FIG. 8. Performance was benchmarked against the surface 12 without particles 40. For each test case, heat transfer coefficient versus heat flux (h-q curve) is plotted in FIG. 9. The boiling curves are described in order of decreasing particle size below.

For the surface 12 without particles 40, natural convection heat transfer occurred at low heat fluxes (below 20 kW/m$^2$). The boiling curve for the surface 12 did not indicate a noticeable temperature overshoot at the transition between convection and boiling regimes. Following transition, the boiling curve was smooth, and the wall superheat consistently increased with increasing heat flux. The coverage area of nucleate boiling spread as the heat flux increased, until the entire heated surface area boiled at a heat flux of about 70 kW/m$^2$. When the heat flux increased to 146 kW/m$^2$, a sharp increase in the wall superheat was measured, and a change in the heat transfer regime from nucleate boiling to film boiling was observed. The boiling occurred on the boundary between the surface 12 and the epoxy layer 28. It was suspected that bubble nucleation on the boundary in these experiments was a result of the low surface tension of FC-72. The comparatively lower surface tension allowed tiny surface cavities, formed by the change in topography at this location, to act as preferential nucleation sites.

For the 3 mm particles 40, the surface 12 was entirely covered by a monolayer of one hundred particles 40. The particles 40 placed on the heated surface 12 increased the heat transfer performance primarily by activation of bubble nucleation from narrow gap corners. The number of active nucleation sites increased as the heat flux increased. This addition of 3 mm particles 40, and the resulting increase in active nucleation sites at a comparably lower superheat, yielded only a moderate improvement in the boiling performance compared to the surface 12 without particles 40 at low heat fluxes. However, the nucleate boiling heat transfer performance deteriorated at a heat flux of about 40 kW/m$^2$, and became comparatively worse than the surface 12 without particles 40 above this heat flux. At 51 kW/m$^2$, film boiling began in the 3 mm particulate layer, which was identified by a sharp increase in the wall superheat. The reduction in CHF for millimeter-size particles was attributed to inefficient liquid-vapor counterflow caused by the dense packing of particles 40 on the surface 12. In other words, compared to the surface 12 without particles 40, there was an increase in the flow resistance to vapor escaping from the surface 12 and to liquid return to the gaps and cavities where it was vaporized.

Figure 8:
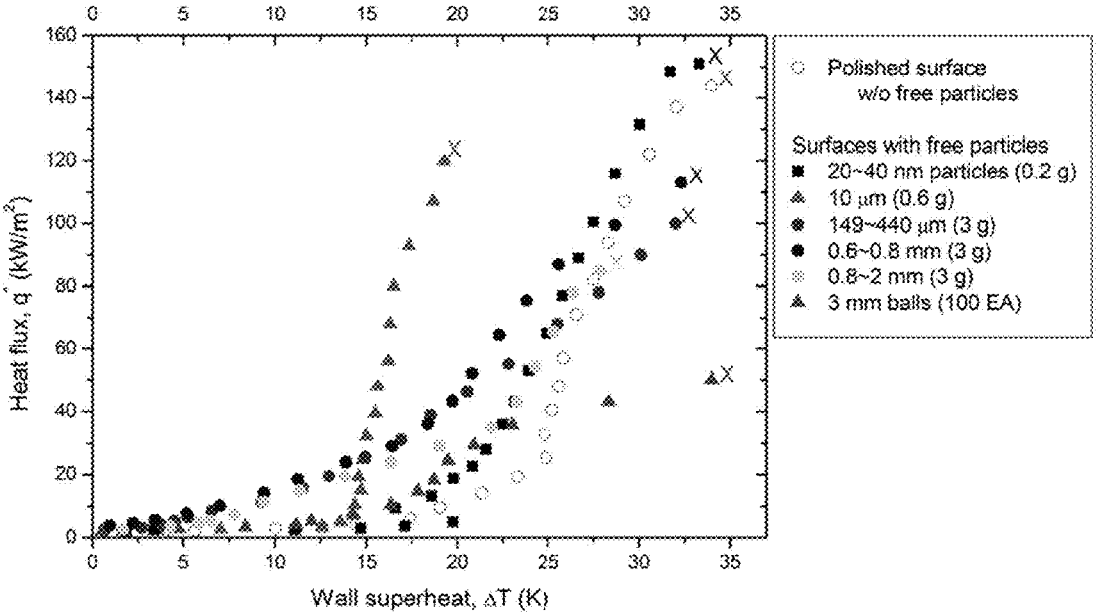
FIG. 8 is a chart representing boiling curves for a range of free particles from a second series of experiments using FC-72 as a working fluid. The point of critical heat flux is represented with an "X" on the chart.
Figure 9:
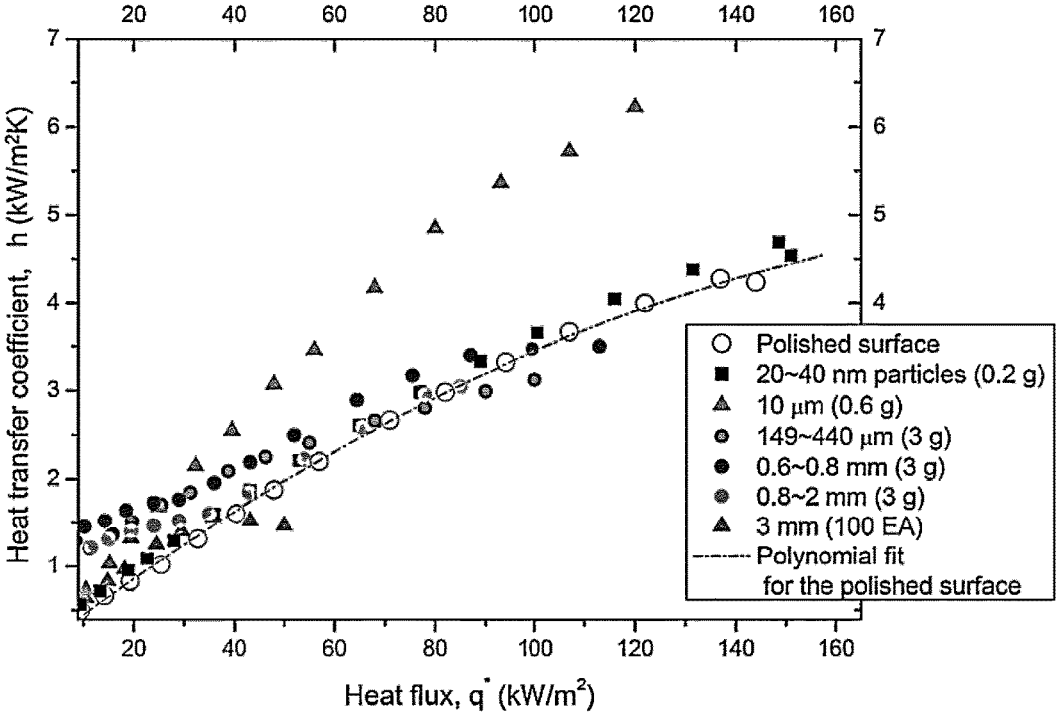
FIG. 9 is a chart representing heat transfer coefficient versus heat flux curves for the same experimental cases as presented in FIG. 2. The dash-dotted line indicates a third order polynomial fit to the surface without the free particles.

Introduction of the particles 40 having sizes of several hundreds of micrometers onto the surface 12 facilitated bubble nucleation at a low wall superheat, and improved nucleate boiling heat transfer more significantly than the millimeter-size particles 40. Separate test cases of 3 g of 0.8-2 mm, 0.6-0.8 mm, and 149-440 μm particle ranges had similar boiling curve trends, as shown in FIG. 8. These respective particle sizes led to uniform nucleate boiling over the surface 12 at low heat fluxes. Each of these cases had a higher heat transfer coefficient than the surface 12 without particles 40 up to heat fluxes of around 80, 95, and 70 kW/m$^2$, respectively.

Since the particles 40 were not fixed to the surface 12, their position and thickness migrated along the surface 12 due to the surrounding fluid flow patterns. The particle motion caused slight differences in boiling curve trends for each size with increasing heat flux. For the 0.8-2 mm particles 40, the heaviest particles 40 remained on the surface 12 at high heat fluxes. However, the particles 40 collected over some parts of the heated surface 12, revealing the surface 12 to the working fluid of the liquid bath 14. Over these areas with the surface 12 exposed, nucleation was suppressed, and the mechanism of heat transfer changed to convection. This less effective heat transfer mechanism caused the boiling curve and the h-q curve for the 0.8-2 mm particles 40 to deviate from the other 0.6-0.8 mm and 149-440 μm particle size cases. For the intermediate 0.6-0.8 mm particles 40, boiling was maintained over the entire surface 12 without noticeable particle redistribution. The lightest 149-440 μm particles 40 were easily moved about the surface 12 by bulk fluid motion and agglomerate near the center of the surface 12. As a result, some of the corners of the surface 12 were exposed directly to the working fluid, similar to the case of 0.8-2 mm particles 40, and boiling was suppressed over these areas. For this reason, among these particle size groups with the same total weight of 3 g, the 0.6-0.8 mm particles 40 showed the most average improvement in boiling heat transfer up to a heat flux of about 100 $kW/m^2$. The measured CHF values for 0.8-2 mm, 0.6-0.8 mm, and 149-440 μm particle groupings were 87, 115, and 102 $kW/m^2$, respectively. This corresponds to 60, 79, and 70% of CHF for the surface 12 without particles 40, and the reduction was similarly attributed to liquid-vapor counter-flow resistance at the nucleation sites as described for the millimeter-size particles 40.

As the size of the particles 40 decreased to 10 μm in these experiments, each particle 40 was significantly smaller than the observed bubble departure diameter and did not provide a unique nucleation site. Thus, nucleate boiling did not occur over the entire surface 12 for 0.6 g of 10 μm particles 40 at low heat fluxes. Instead, several nucleation sites activated over the surface 12 and locally displaced the layer of 10 μm particles 40. Boiling was observed at each nucleation site. As the heat flux increased to 10.5 $kW/m^2$, the nucleation sites extended over a larger area and pull neighboring particles 40 away from the surface 12 along with the rising vapor. Intense nucleate boiling that occurred at each nucleation site enhanced boiling heat transfer compared to all previous test cases, and a steep slope in the boiling curve was observed for the heat fluxes above 10.5 $kW/m^2$ (FIG. 8). A weight of 0.6 g of 10 μm particles 40 maintained the wall superheat below 20 K until CHF was reached. Critical heat flux occurred at a heat flux of 123 $kW/m^2$, corresponding to 84% of the surface 12 without particles 40. This may be a result of a large quantity of particles 40 that were observed to stay affixed to the surface 12 up to CHF, and hinder liquid replenishment to the surface 12.

When nanoscale particles 40 were used, little effect was observed on the nucleate boiling heat transfer performance of FC-72. The surface 12 coated with 0.2 g of 20-40 nm particles 40 maintained marginally lower wall superheats compared to the surface 12 without the particles 40 across the entire range of heat fluxes. Several nucleation sites that displaced particles 40 in a similar manner to the 10 μm size particles 40 described above were formed. At a heat flux of 5.0 $kW/m^2$, the nucleation sites were observed to be active at some of the corners of the surface 12. The particles 40 near other corners were moved toward the center of the surface 12 due to bulk fluid flow, and did not provide active nucleation sites, similar to the 149-440 μm particles 40. As the heat flux increased to 9.4 $kW/m^2$, the liquid bath 14 became translucent due to the increased quantity of suspended nanoscale particles 40. In contrast to the 10 μm and larger particles 40 that stayed on the surface 12 up to CHF, the nanoscale particles 40 were completely suspended in the liquid bath 14, and increased CHF to 153 $kW/m^2$. This represented a 5% improvement compared to the surface 12 without particles 40. The slight improvement in CHF was expected to be caused by the change in physical properties (wettability) of the working fluid containing nanoscale particles 40.

Figure 10:
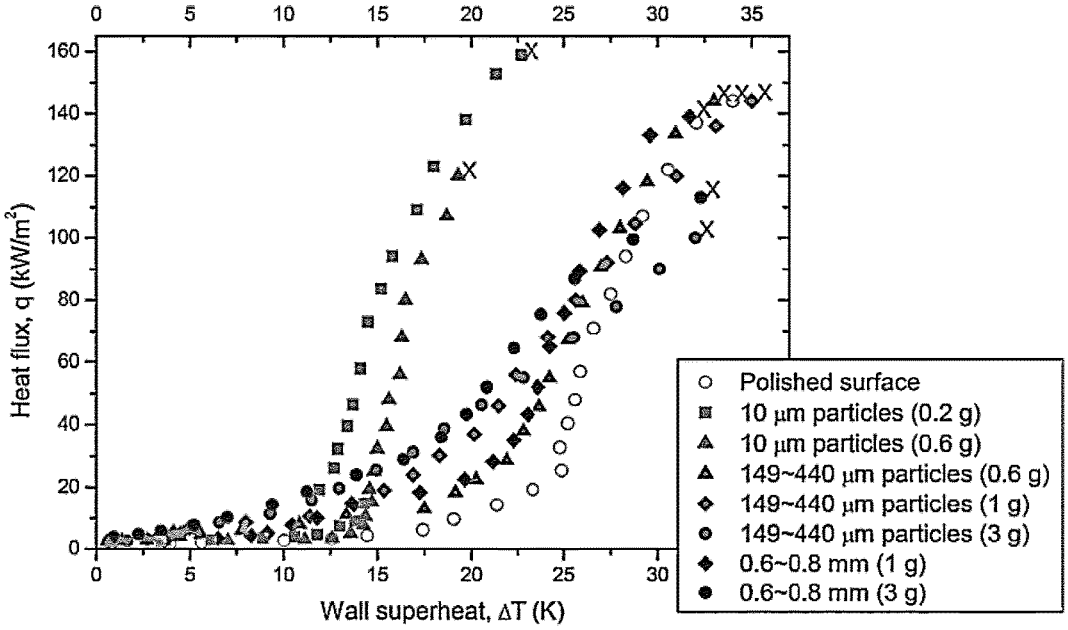
FIG. 10 is a chart representing boiling curves for variable quantities of a given free particle size from the second series of experiments using FC-72 as a working fluid. The point of critical heat flux is represented with an "X" on the chart.
Figure 11:
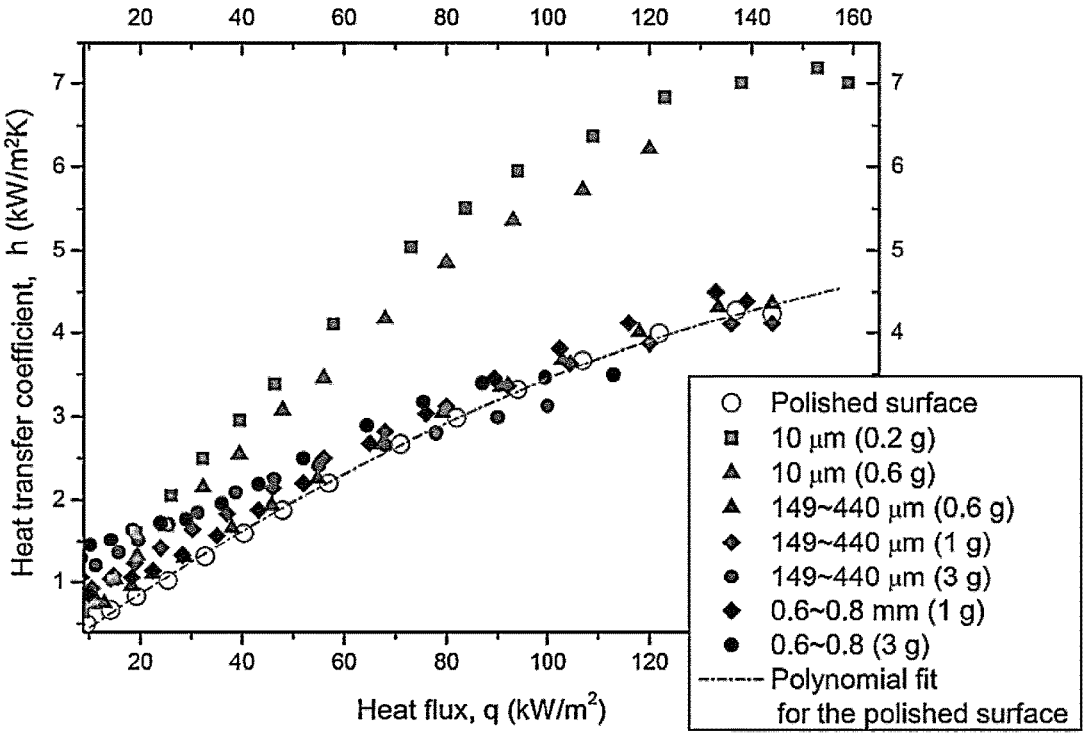
FIG. 11 is a chart representing heat transfer coefficient versus heat flux curves for the same experimental cases as presented in FIG. 4.

Next, the effect of the number of the particles 40 on nucleate boiling heat transfer coefficients and CHF using FC-72 was investigated. FIG. 10 and FIG. 11 present the boiling curves and the corresponding heat transfer coefficients for variable quantities of a given particle size (10 μm, 149-440 μm, and 0.6-0.8 mm).

As a general trend for all particle sizes tested, the nucleate boiling heat transfer coefficient increased with an increasing number of particles 40 at low heat fluxes after the onset of nucleate boiling. For example, 3 g of 0.6-0.8 mm and 149-440 μm particles 40, representing the largest loading for both ranges, exhibited lower wall superheats for heat fluxes below 87 $kW/m^2$ and 54 $kW/m^2$, respectively. Conversely, for the 0.6 g of 149-440 μm particles 40, the least quantity of particles 40 for this particle size, had the lowest heat transfer coefficient up to 67 $kW/m^2$. This suggested that increasing the number of the particles 40 placed on the surface 12 activated more nucleation sites for boiling. An increasing number of particles 40 increased the number of contact points between the surface 12 and the particles 40, which increased of the number of potential nucleation sites. Due to this increased nucleation site density, the nucleate boiling heat transfer performance increased.

A second reason for increasing performance with particle loading was concluded to be due to the number of the particles 40 that remain in contact with the surface 12. The nucleation site density of the surface 12 decreases when the particles 40 are temporarily removed from the surface 12 due to bulk fluid motion. For the sub-millimeter particle sizes described in FIG. 10, unlike larger millimeter-size particles 40 that stay on the surface 12, it was observed that the particles 40 were pulled away from the surface 12 by buoyant vapor that departed from the surface 12. If fewer particles 40 were used, the surface 12 may locally be stripped of particles 40 and boiling suppressed, whereas comparatively higher particle loading may allow such areas to be immediately fed by loose particles 40 that again provide narrow gap corners for nucleation.

While increasing the number of particles 40 increased the heat transfer coefficient at intermediate heat fluxes, reducing the number of the particles 40 mitigated the CHF reduction compared to the surface 12 without particles 40. When 3 g of 149-440 μm particles 40 were introduced, the surface 12 was entirely covered by a thick layer of the particles 40. The thick layer hindered vapor escape form the surface 12, and a transition to film boiling occurred at a heat flux of 102 $kW/m^2$, 70% of the polished surface critical heat flux. For this particular case, the particles 40 evenly spread all over the surface 12 in the vapor space at CHF. This was not observed for any other cases, and indicated that the entire surface 12 was covered by a vapor film. Vapor escape from this vapor-particle layer was observed intermittently. In comparison, reduced 149-440 μm particle quantities of 0.6 g and 1 g had CHF values identical to the surface 12 without particles 40 (146 $kW/m^2$) at a similar wall superheat of around 35 K. For these cases, most of the particles 40 stayed near the surface 12. However, their positions continuously moved about the surface 12 due to the bulk liquid/vapor motion, and some fraction of the particles 40 was entrained in the fluid at CHF. It was concluded that this spontaneous movement of the particles 40 prevented clogging of vapor at the surface 12, and yielded a similar CHF to that of the surface 12 without particles 40.

All trends in regard to the effect of number of particles 40, as described above for 149-440 μm particles 40, were preserved for the 0.6-0.8 mm particles 40. As the quantity of the particles 40 decreased from 3 g to 1 g, there was an inverse relationship with the measured heat transfer coefficients below heat fluxes of 86 $kW/m^2$, yet CHF increased from 115 $kW/m^2$ to 141 $kW/m^2$.

Among all experimental cases with the particles 40 in these experiments, 0.2 g of 10 μm particles 40 showed the most improvement in boiling of FC-72 for a wide range of heat fluxes, from 20 to 160 kW/m$^2$. The boiling phenomena observed for this case were very similar to the observations described for 0.6 g of 10 μm particles 40. As described previously, the formation of nucleation sites differed for this particle size, and nucleation sites formed and spread over the surface 12 on areas where particles 40 were more easily pulled away by the bulk fluid motion. Therefore, in contrast to the conclusions drawn about larger particle sizes in the paragraphs above, the lesser amount of particles 40 in the case of 0.2 g was observed to generate nucleation sites over a larger portion of the surface 12 than for the 0.6 g case yielding higher heat transfer coefficients. Likewise, 0.2 g of 10 μm particles 40 increased CHF compared to the surface 12 without particles 40 by 10%, the largest improvement observed in the second series of experiments (Table 2). This increase in CHF for the lower particle weight of 0.2 g compared to 0.6 g for the 10 μm particles 40 was similar to the trend described for 149-440 μm and 0.6-0.8 mm particles 40 described above. The improvement in CHF by addition of microscale free particles had not been studied previously, and further investigation of the boiling process under these conditions was required to postulate the enhancement mechanism, such as changes in the liquid properties.

TABLE 2

The sizes and weight/number of copper particles used in the experiments.

| Particle Size | Quantity | CHF (kW/m$^2$) |
|---|---|---|
| 20-40 nm | 0.2 g | 153 |
| 10 μm | 0.2 g | 160 |
| | 0.6 g | 123 |
| 149-440 μm | 0.6 g | 146 |
| | 1 g | 146 |
| | 3 g | 102 |
| 600-800 μm | 1 g | 141 |
| | 3 g | 115 |
| 0.8-2 mm | 3 g | 87 |
| 3 mm | 100 each | 51 |
| 6 mm | 25 each | 119 |
| 9 mm | 9 each | 85 |
| Surface without particles | n/a | 146 |

In order to make generalized comparisons across a range of heat fluxes versus the baseline surface 12 without the particles 40, the averaged percentage enhancement in nucleate boiling heat transfer coefficient was quantified using Eq. 10 where $h_i$ and $h_{p,i}$ are the heat transfer coefficients of the experiments and the surface 12 without particles 40 at each heat flux, for n data points. In order to compare over a continuous range of heat fluxes, $h_{p,i}$ was obtained from a polynomial fit of the polished h-q" curve, given as $$h_{p,i}=0.018+0.044q_i-0.0098\times10^{-2}q_i^2 \quad (12)$$

Using Eq. 12, improvements in nucleate boiling due to 0.2 g of 10 μm the particles 40 was evaluated. The average percentage enhancement in nucleate boiling heat transfer coefficient was about 77% compared to the surface 12 without particles 40 using a heat flux range of 10 to 150 kW/m$^2$ for comparison. This was in contrast to the least effective test case, one hundred 3 mm the particles 40, which exhibited only a 7.2% improvement for the heat flux range of 10-50 kW/m$^2$.

Figure 12:
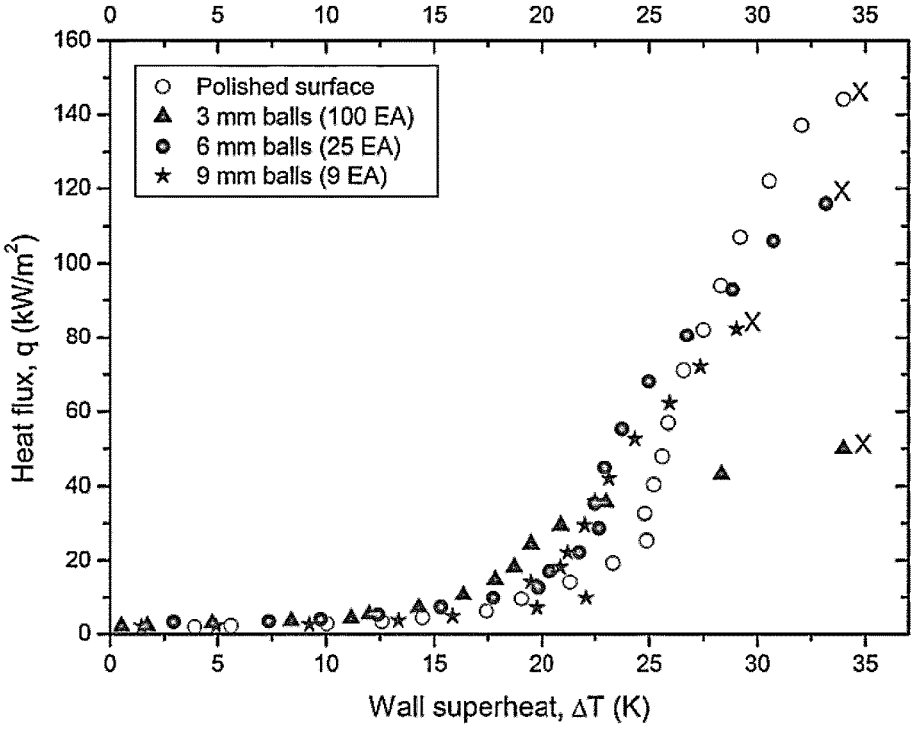
FIG. 12 is a chart representing boiling curves from the second series of experiments using FC-72 as a working fluid for quantities of free particle size originally used in the first series of experiments.

As observed in the first series of experiments utilizing water as the working fluid, particle sizes of 3 mm were optimal for low heat fluxes near the onset of nucleate boiling, and 6 mm particles showed the best heat transfer performance at high heat fluxes. In contrast, millimeter-size particles showed little effect on the nucleate boiling heat transfer coefficient for FC-72 (FIG. 12), and resulted in a decrease in CHF (Table 2). The difference in optimum particle size was attributed to the differences in thermophysical properties and wetting characteristics of the working fluids. FC-72 is a highly wetting fluid, with a low surface tension of 0.010 N/m at 25° C., versus 0.072 N/m for water. Thus, it can be understood that smaller gaps and cavities promote nucleation in FC-72.

While the invention has been described in terms of specific embodiments, it is apparent that other forms could be adopted by one skilled in the art. For example, the working fluid could be a liquid other than water and FC-72, including but not limited to other fluorocarbons, and materials and processes other than those noted could be used. Therefore, the scope of the invention is to be limited only by the following claims.

The invention claimed is:

1. A method of increasing boiling heat transfer from a surface, the method comprising:

placing free particles on a surface so that the free particles are not affixed to the surface and are free to move on and relative to the surface, the free particles defining narrow corner gaps and cavities at interfaces between the free particles and the surface; and heating the surface while the surface is contacted by a working fluid to bring the working fluid to a boil and cause the free particles to continuously move on and relative to the surface, at least some of the free particles remaining in contact with the surface and the narrow corner gaps and cavities thereof facilitating bubble nucleation and increasing nucleate boiling heat transfer from the surface;

wherein the free particles comprise at least a first group of the free particles having first diameters and at least a second group of the free particles having second diameters that are different from the first diameters, wherein the first diameters are sized to increase the critical heat flux of the working fluid and the second diameters are sized to decrease the temperature necessary to facilitate bubble nucleation in the working fluid.

2. The method of claim 1, wherein heating the surface causes translational or rolling motions of the free particles.

3. The method of claim 1, the method further comprising using the working fluid in a phase-change process to cool an apparatus.

4. The method of claim 3, wherein the apparatus is chosen from the group consisting of industrial engines, industrial reactors, industrial plants, electronics, and electromechanical systems.

5. The method of claim 1, wherein the free particles are spherical.

6. The method of claim 1, wherein the free particles are non-spherical.

7. The method of claim 1, wherein the working fluid is water.

8. The method of claim 7, wherein the free particles have average diameters that are millimeter-sized.

9. The method of claim 7, wherein the average diameters are between about three and about six millimeters.

10. The method of claim 1, wherein the working fluid is a fluorocarbon.

11. The method of claim 10, wherein the working fluid is perfluorohexane.

12. The method of claim 10, wherein the free particles have average diameters that are micrometer-sized.

13. The method of claim 10, wherein the average diameters are about ten micrometers.

14. The method of claim 1, wherein the free particles placed on the surface are in a quantity to promote boiling over the entirety of the surface during boiling.

15. The method of claim 1, wherein the free particles form a layer on the surface having a thickness approximately equal to a diameter of one of the free particles.

16. The method of claim 1, wherein the free particles placed on the surface are in a quantity adapted to substantially cover the entirety of the surface during boiling.

17. The method of claim 1, wherein the free particles are formed of a material that is more conducting than the working fluid.

18. The method of claim 1, wherein the free particles have a weight sufficient for the free particles to remain on or near the surface during boiling.

19. The method of claim 1, wherein the surface is a portion of an apparatus chosen from the group consisting of industrial engines, industrial reactors, industrial plants, electronics, and electromechanical systems.

20. A method of increasing boiling heat transfer from a surface, the method comprising:

placing free particles on a surface so that the free particles are not affixed to the surface and are free to move on and relative to the surface, the free particles defining narrow corner gaps and cavities at interfaces between the free particles and the surface; and heating the surface while the surface is contacted by a working fluid to bring the working fluid to a boil and cause the free particles to continuously move on and relative to the surface, the narrow corner gaps and cavities facilitating bubble nucleation and increasing nucleate boiling heat transfer from the surface;

wherein the free particles comprise at least a first group of the free particles having first diameters and at least a second group of the free particles having second diameters that are different from the first diameters, wherein the first diameters are sized to increase the critical heat flux of the working fluid and the second diameters are sized to decrease the temperature necessary to facilitate bubble nucleation in the working fluid.

21. The method of claim 20, the method further comprising using the working fluid in a phase-change process to cool an apparatus chosen from the group consisting of industrial engines, industrial reactors, industrial plants, electronics, and electromechanical systems.

22. The method of claim 20, wherein the first group is placed on the surface in a different quantity than the second group.

23. An apparatus comprising:

a heated surface;

a working liquid in contact with the surface; and free particles submerged in the working fluid and located on the surface but not affixed to the surface so that the free particles are free to move on and relative to the surface, the free particles defining narrow corner gaps and cavities at interfaces between the free particles and the surface, wherein the working fluid is boiling as a result of heat transfer from the surface to the working fluid and causes the free particles to continuously move on and relative to the surface, and wherein bubble nucleation and an increase in nucleate boiling heat transfer from the surface are facilitated by the narrow corner gaps and cavities of at least some of the free particles that remain in contact with the surface;

wherein the free particles comprise at least a first group of the free particles having first diameters and at least a second group of the free particles having second diameters that are different from the first diameters, wherein the first diameters are sized to increase the critical heat flux of the working fluid and the second diameters are sized to decrease the temperature necessary to facilitate bubble nucleation in the working fluid.

24. The apparatus of claim 23, wherein the apparatus is chosen from the group consisting of industrial engines, industrial reactors, industrial plants, electronics, and electromechanical systems.

* * * * *